US006942000B2

(12) United States Patent
Hoerner et al.

(10) Patent No.: US 6,942,000 B2
(45) Date of Patent: Sep. 13, 2005

(54) COUPLING MECHANISM AND PANEL FOR SECTIONAL DOOR

(75) Inventors: Bill Hoerner, Dubuque, IA (US); Tom Jansen, Dubuque, IA (US); Perry Knutson, Lancaster, WI (US)

(73) Assignee: Rite-Hite Holding Corporation, Milwaukee, WI (US)

( * ) Notice: Subject to any disclaimer, the term of this patent is extended or adjusted under 35 U.S.C. 154(b) by 0 days.

(21) Appl. No.: 09/249,916

(22) Filed: Feb. 12, 1999

(65) Prior Publication Data

US 2002/0056529 A1 May 16, 2002

Related U.S. Application Data

(62) Division of application No. 08/679,411, filed on May 28, 1996, now abandoned.

(51) Int. Cl.[7] ..... E06B 3/48

(52) U.S. Cl. ..... 160/229.1; 160/371; 160/377; 49/463

(58) Field of Search ..... 160/229.1, 232, 160/371, 377, 379, 231.1, 231.2, 233, 236; 49/463, 501; 52/309.14, 800.12

(56) References Cited

U.S. PATENT DOCUMENTS

| | | | | | |
|---|---|---|---|---|---|
| 2,091,012 | A | * | 8/1937 | Pratt | 160/232 |
| 3,571,976 | A | * | 3/1971 | Schmid | 49/130 |
| 3,629,046 | A | * | 12/1971 | Gilbert | 428/71 |
| 4,019,555 | A | * | 4/1977 | Oshiro | 160/371 |
| 4,226,910 | A | * | 10/1980 | Dahlen | 52/309.14 X |
| 4,347,796 | A | * | 9/1982 | King et al. | 109/49.5 |
| 4,379,480 | A | * | 4/1983 | Kempel et al. | 160/232 |
| 4,441,301 | A | * | 4/1984 | Benson | 52/804 |
| 4,518,026 | A | * | 5/1985 | Otto et al. | 160/232 |
| 4,532,743 | A | * | 8/1985 | Miller et al. | 52/207 |
| 4,567,931 | A | * | 2/1986 | Wentzel | 160/232 |
| 4,747,441 | A | * | 5/1988 | Apolzer et al. | 160/232 X |
| 4,752,517 | A | * | 6/1988 | Beitel | 428/122 |
| 4,989,688 | A | * | 2/1991 | Nelson | 181/287 |
| 5,006,391 | A | * | 4/1991 | Biersach | 428/116 |
| 5,177,868 | A | * | 1/1993 | Kyle et al. | 29/897.32 |
| 5,237,776 | A | * | 8/1993 | Kubota | 49/319 |
| 5,351,442 | A | * | 10/1994 | Gingras | 49/411 |
| 5,445,208 | A | * | 8/1995 | Shaner et al. | 160/232 |
| 5,509,457 | A | * | 4/1996 | Jella | 160/232 X |
| 5,613,541 | A | * | 3/1997 | Bradbury | 160/232 X |
| 5,727,349 | A | * | 3/1998 | McLaughlin | 49/501 |
| 5,743,057 | A | * | 4/1998 | Martin | 49/501 X |
| 5,775,041 | A | * | 7/1998 | Tull et al. | 49/501 X |
| 5,799,449 | A | * | 9/1998 | Lyons et al. | 296/201 X |
| 5,848,508 | A | * | 12/1998 | Albrecht | 52/309.14 X |
| 5,853,512 | A | * | 12/1998 | McKinney | 156/78 |
| 5,857,307 | A | * | 1/1999 | Takemasa et al. | 52/784.15 |
| 6,041,846 | A | * | 3/2000 | Langlois | 160/201 |
| 6,062,293 | A | * | 5/2000 | Berger, Jr. | 160/229.1 |
| 6,119,307 | A | * | 9/2000 | Weishar et al. | 16/87 R |
| 6,263,943 | B1 | * | 7/2001 | Lai | 160/133 |
| 2003/0079423 | A1 | * | 5/2003 | Kennedy et al. | 52/204.1 |

FOREIGN PATENT DOCUMENTS

| | | | | |
|---|---|---|---|---|
| JP | 06248585 | * | 9/1994 | 160/229.1 X |
| JP | 2002184683 | * | 6/2002 | 160/229.1 X |

* cited by examiner

*Primary Examiner*—Bruce A. Lev
(74) *Attorney, Agent, or Firm*—Hanley, Fliight & Zimmerman, LLC

(57) ABSTRACT

An improved coupling mechanism for adjacent panels of a sectional door, the panels including facing, adjacent edges; the coupling mechanism including at least one recess formed in or disposed adjacent to the facing edge of each panel, and also including at least one pliable hinge member having a body portion, and expanded regions at each end of the body portion, which are received within and movable within the facing recesses to provide for the relative movement between the facing edges of the panels as the door moves between blocking and unblocking positions.

4 Claims, 3 Drawing Sheets

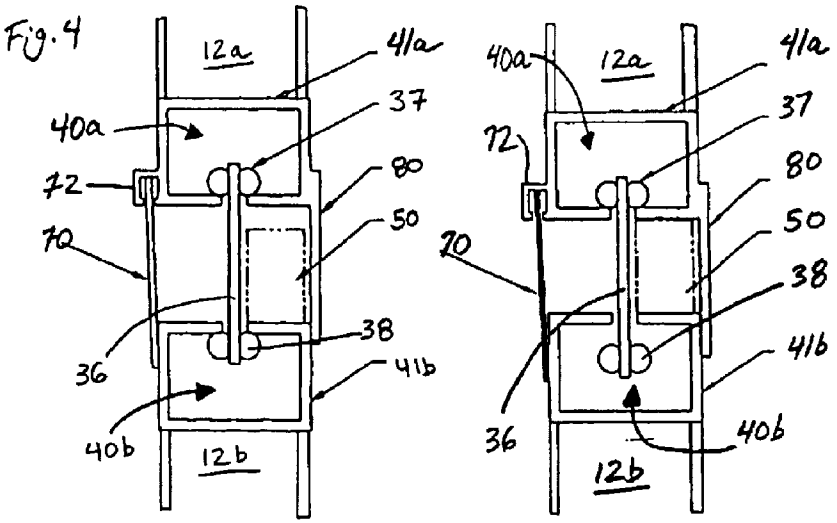
Fig. 4
Fig. 5
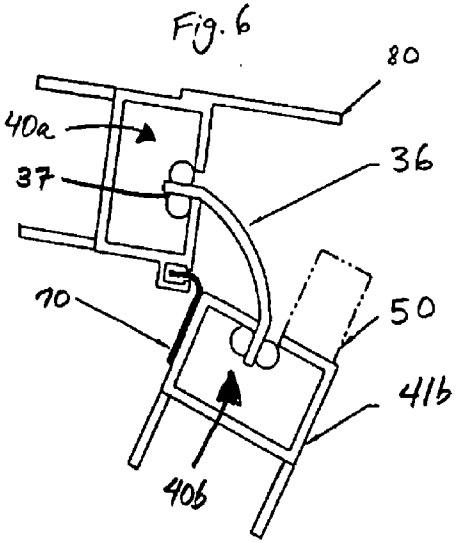
Fig. 6
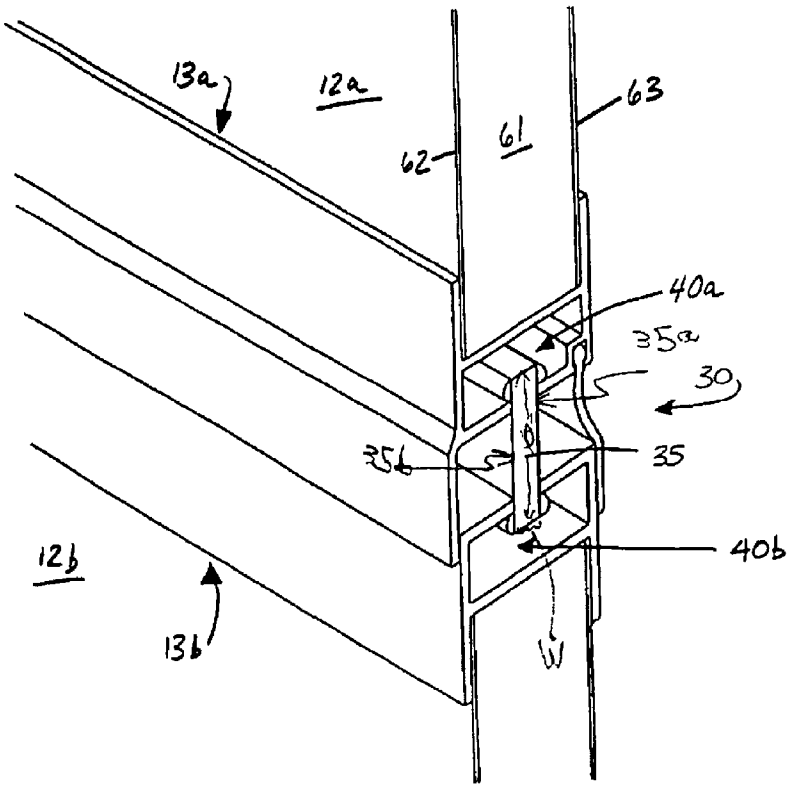
Fig. 3

COUPLING MECHANISM AND PANEL FOR SECTIONAL DOOR

CROSS-REFERENCE TO RELATED APPLICATIONS

This application is a divisional of application Ser. No. 08/679,411 filed May 28, 1996 now abandoned.

FIELD OF THE INVENTION

The invention is directed generally to sectional doors, and more particularly to a hinge and spacer mechanism for coupling adjacent panels in such a door.

BACKGROUND OF THE INVENTION

Sectional doors are used in a wide variety of industrial, commercial and private settings. A common example of a sectional door is a conventional garage door. Sectional doors typically comprise a series of panels hinged together to form the door, and the door is movable between a range of doorway-blocking positions, in which one or several of the panels extend across the doorway opening, and unblocking positions. A sectional door is most commonly stored in a so-called "overhead" configuration. In such a configuration, a guide track is disposed on either side of the doorway, with one leg (adjacent to the doorway opening) extending vertically along the doorway, and the second leg (projecting back from the doorway opening) disposed above and behind the doorway (i.e., "overhead"). A curved track section joins the two legs. Associated with the panels making up the door are a series of rollers, which are received within and guided by the tracks to guide the panels and thus the door between its blocking and unblocking positions. Sectional doors may also be stored in a vertical orientation directly above the doorway opening. That is they may have straight tracks and be movable in a continuous plane between doorway-blocking and doorway opening positions. Typically, the panels comprising such a sectional door are formed of either metals, wood, or composite structures either glued or riveted together.

The panels which form a sectional door are commonly coupled to each other by means of hinges disposed between adjacent panels. In overhead storing doors, these hinges are required to allow the panels to pivot with respect to each other so that successive panels can change their orientation from the vertical to the horizontal, or vice versa, as they move either toward or away from the overhead, stored position. While these hinges are needed for proper door activation, they also have disadvantages. For example, the hinges create spaces or gaps between successive panels the sizes of which change as the door travels, and which may thus become pinch points. While the size of these gaps is typically largest when the two successive panels are adjacent the curved portion of the track, they may be present for other orientations of the door, particularly when the door is near the fully closed position. As the door moves to the fully closed position, the accumulated weight of the door will compress any gaps between successive panels, pinching them together. Such a pinching action may be a hazard either to personnel or to valuable cargo in the vicinity of the door. The gaps between panels also allow air to leak past the door. In refrigerated or other temperature-controlled warehouses or other industrial installations, the leakage through these gaps may be substantial and thus costly. Finally, sectional doors in an industrial environment will be subjected to impacts—typically by fork trucks or other material handling equipment, or by the load which they are carrying.

Accordingly, damage may result. If a panel is damaged, the hinges associated with that panel must all be removed and possibly replaced. Further, the panel must then be removed and replaced and the associated hinges re-attached. Such a repair operation may be both time-consuming and costly.

SUMMARY OF THE INVENTION

Accordingly, it is the primary aim of the present invention to provide an improved coupling mechanism for the panels of a sectional door as compared to those previously provided.

In accordance with that aim, it is an object of the invention to provide a sectional door coupling mechanism that provides proper door actuation while minimizing potential safety hazards.

It is a further object to provide a coupling mechanism exhibiting improved sealing and leak prevention between adjacent panels.

Another object is to provide a panel coupling mechanism that is easy to implement, and to service in the event of damage to the door.

In accordance with these and other objects of the invention, there is provided an improved coupling mechanism for adjacent panels of a sectional door. The adjacent panels with which the coupling mechanism is associated include facing, adjacent edges. The coupling mechanism includes at least one recess formed in or disposed adjacent to the facing edge of each panel. To allow for relative movement between the edges of the panel, the coupling mechanism also includes at least one pliable hinge member. The hinge member includes a body portion, and expanded regions at each end of the body portion, which are received within and movable within the facing recesses to provide for the relative movement between the facing edges of the panels as the door moves between blocking and unblocking positions. To ensure that a minimum spacing is maintained between the adjacent edges, and to minimize the existence of a pinch point between the panels, at least one spacer member is disposed between the facing edges of the panels.

According to a preferred embodiment of the invention, an endpiece is provided which is disposed on each of the adjacent panels on their facing edges. This endpiece may illustratively be an extrusion, preferably including the recess formed integrally therein, and running the length of the endcap. The pliable hinge member may be a fabric hinge with a generally flat body, and expanded end regions. The end regions are large enough to prevent them from leaving the recesses once assembled, but are still capable of movement within the recesses to provide for the relative movement between panels needed for door operation. Each extrusion may also include a spacer member formed integrally thereon.

The embodiments of the invention will be described herein in reference to the appended drawings, wherein:

BRIEF DESCRIPTION OF THE DRAWINGS

FIG. 3 is a perspective view showing two adjacent panels coupled together with a coupling mechanism according to an embodiment of the invention;

FIG. 4 is a sectional view of a coupling mechanism according to an embodiment of the invention with the panels in a vertical orientation during movement between blocking and unblocking positions;

FIG. 5 is a sectional view of a coupling mechanism according to an embodiment of the invention with the panels in a vertical orientation, but with the door in a fully-closed position;

FIG. 6 is a sectional view of a coupling mechanism according to an embodiment of the invention with the panels rotated relative to each other, as during movement past the curved portion of a track toward a fully-open position;

DETAILED DESCRIPTION OF THE PREFERRED EMBODIMENTS

While the invention will be described in connection with certain preferred embodiments, there is no intent to limit it to those embodiments. On the contrary, the intent is to cover all alternatives, modifications and equivalents as are included within the scope and spirit of the invention as defined by the appended claims.

Figure 2:
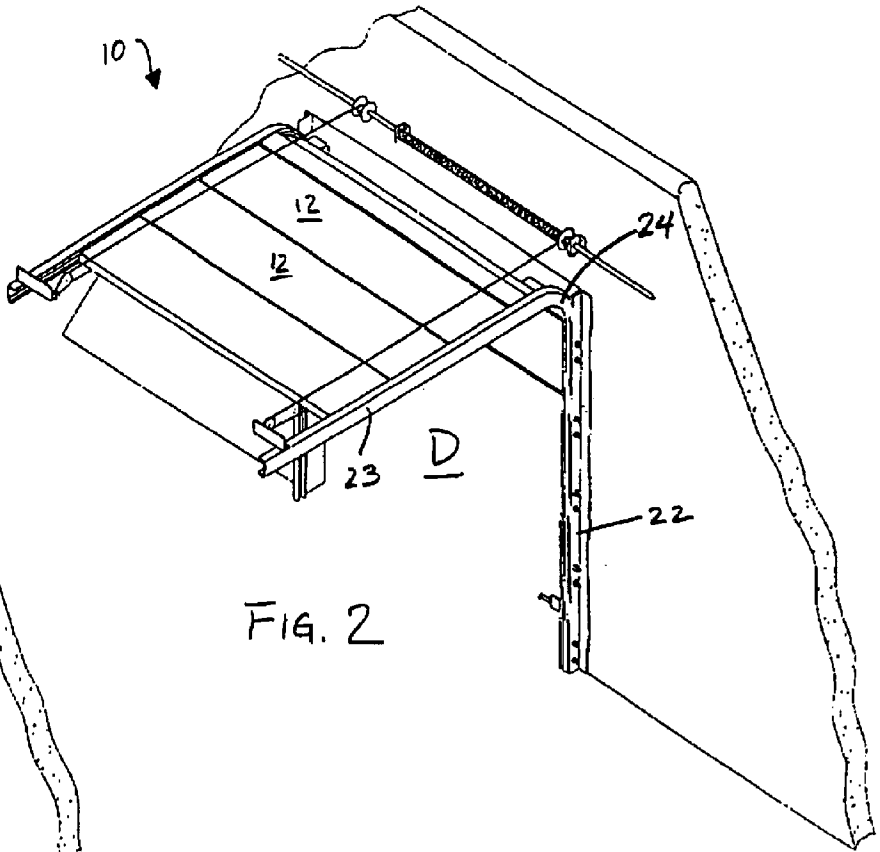
FIG. 2 is a perspective view of the sectional door of FIG. 1, and showing the door in an open position.
Figure 1:
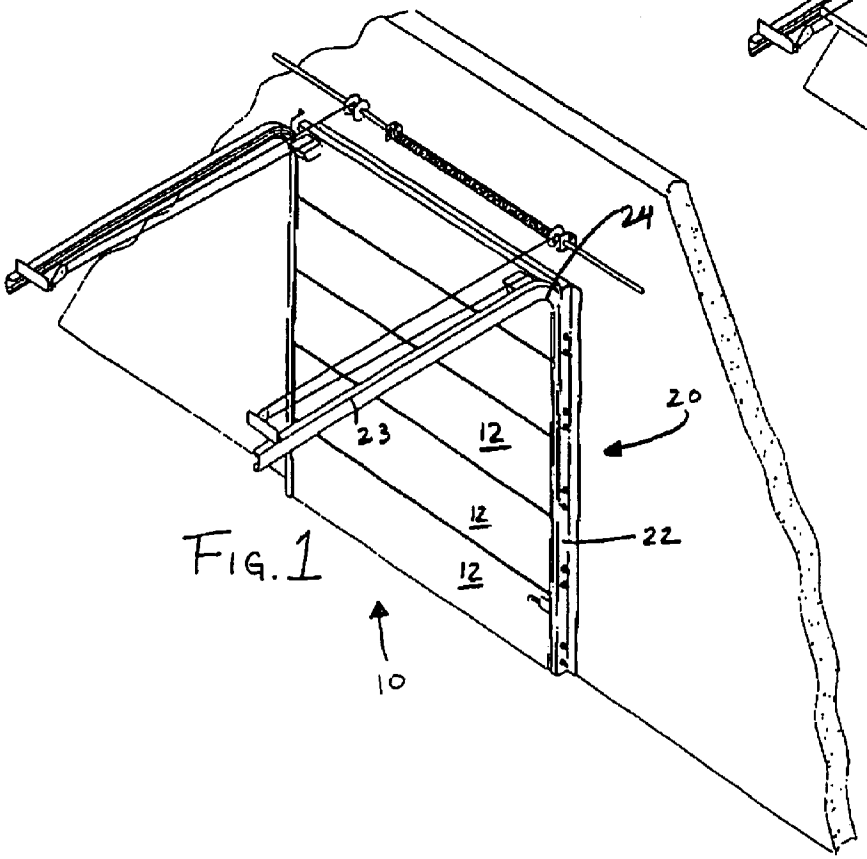
FIG. 1 is a perspective view of a sectional door of the type with which the coupling mechanism of the invention is preferably used, and shown in a door closed position.

The coupling mechanism according to the invention will preferably be used in combination with a sectional door, like that shown in FIGS. 1 and 2. The sectional door 10 is comprised of a series of panels 12 which extend across the door opening (D in FIG. 2) when the door 10 is in a doorway blocking position, such as the fully—position shown in FIG. 1. In a conventional manner, door 10 is also movable to unblocking positions, such as the fully-open position of FIG. 2. It will be appreciated that the door 10 has a range of doorway blocking positions in which one or more panels 12 extend across the doorway D. To guide the door between its blocking and unblocking positions, a track 20 is disposed on either side of the doorway D. Since the door 10 in FIGS. 1 and 2 is of the overhead-storing configuration, the track 20 includes a first, vertical leg 22, and a second, horizontal leg 23, joined by curved section 24. The panels 12 forming door 10 typically include rollers (not shown) extending from the lateral edges of the panels, and which are received within the track to guide it during travel. Alternatively, the track may be formed such that the ends of the panel may be directly received within the track 20, eliminating the need for rollers. The coupling mechanism according to the invention may be used with either type of door, and with other configurations of sectional doors.

The coupling mechanism according to the invention is used to couple adjacent panels together. Typically, such coupling is performed by a conventional hinge, having a leg attached to each of the panels. The conventional hinge allows the panels to pivot relative to each other so that, for example, successive panels can navigate the curved section of the track 24. The novel coupling mechanism according to the invention provides this same function, but with other attendant advantages. An example of the coupling mechanism according to the invention is illustrated in FIG. 3, showing two adjacent panels in a perspective view. For purposes of illustration, the upper panel will be designated 12*a* and the lower panel 12*b*. The two panels 12*a,b* have adjacent, facing edges 13*a* and 13*b* with which the coupling mechanism 30 is associated. In its broadest sense, the coupling mechanism 30 includes a pliable hinge member 35 which couples the facing edges 13*a* and 13*b* together. In this embodiment, the hinge member 35 extends the width of the door, although a plurality of spaced hinge members 35 could also be used. The coupling mechanism of the invention also includes recesses 40*a,b* disposed adjacent the facing edge of the panels, and within which respective ends of the pliable hinge member 35 are received. In this embodiment, the recesses 40 run the entire width of the panels 12. Alternatively, discrete, spaced recesses 40 could be disposed opposite each other in or adjacent to the facing edges 13*a* and 13*b*, and be coupled to each other by hinge individual hinge members 35.

To form the recesses 40 in this embodiment, each of the panels 12*a,b* includes an endcap 41*a,b* (respectively) in the form of a preferably aluminum extrusion, which is disposed adjacent the facing edges 13*a,b* of the panels 12*a,b*. Toward that end, the extrusion forms part of a frame within which other components of the panel are received, as seen in greater detail in the exploded view of FIG. 7, and as will be described in greater detail below. As best seen in the section views of FIGS. 4–6, the extrusions 41*a,b* are illustratively rectangular tubes, having slots formed in the side thereof which faces the adjacent panel, to provide the recess 40, which in this embodiment includes not only the slot or opening itself, but also the remainder of the interior of the extrusion. The pliable hinge member 35 includes a body portion 36 and opposed ends 37, 38 comprising expanded regions. In this embodiment, the hinge member 35 is formed of a plastic material, preferably a vinyl material with a polyester web reinforcement giving the member 35 the necessary pliability to be bent and straightened repeatedly without undue wear. The expanded regions of the opposed ends 37 and 38 in this embodiment, are formed of a pair of rods of the plastic (vinyl) material which extend longitudinally along the body portion 36. Presently, the rods are attached to the body portion 36 by a vinyl weld, although other, stronger attachment means could be used. Further, the body portion 36 and expanded regions 37, 38 could also be unitary.

To allow for relative movement between the facing edges of the panels 12*a,b* when they are coupled together by the coupling mechanism of the invention, the recesses 40*a,b* are formed so as to retain the expanded regions of the hinge member 35, while still allowing those expanded regions (and the attached body 36) to move within the recesses 40*a,b*. This allows the facing edges 13*a,b* of the panels 12*a,b* to move toward each other, or move away from each other, or rotate with respect to each other, depending on the forces being applied to the panels. An example of each of these relative movements of the panels can be seen in reference to FIGS. 4–6. In FIG. 4, the panels 12*a,b* are vertically oriented and in motion between doorway-blocking and doorway-unblocking positions. The weight of the lower panel 12*b* thus pulls downward, separating the panels. Hinge member 35 allows for this, but limits the separation when the two expanded regions 37 and 38 engage on the shoulders of the respective recesses 40*a,b* in the extrusions on each panel. As the panels 12*a,b* reach the fully-closed position of FIG. 1, however, the facing edges of the panels move toward each other. This is caused by the fact that the lower panel 12*b* will stop moving downwardly before the next higher panel 12*a*. In the case of the lowermost panels on the door 10, the lowest panel 12 will engage the floor and stop moving downward, while the next higher panel, due to gravity and inertia, will continue downward. Since the lower expanded region 38 of the hinge member 35 is movable within its recess 40*b* (compare FIGS. 4 and 5), the coupling mechanism of the invention provides for lost motion, allowing the upper panel 12*a* to move toward the lower panel 12*b*. However, according to a significant aspect of the present invention, a minimum spacing is maintained between the panels. This minimum spacing prevents the facing edges of the panels 13*a,b* from pinching together, which pinching could present a safety hazard.

To maintain this minimum spacing, the coupling mechanism according to the invention includes a spacer member disposed between the facing edges 13*a,b* of the panels. The spacing member is clearly shown in FIGS. 4 and 5. According to this embodiment of the invention, the spacing member is in the form of a block 50 attached to one of the extrusions, in this case the extrusion 41*b* on the bottom panel. Accordingly, as the lost motion action of the hinge allows the facing edges of the panels 12 to approach each other, the extrusion attached to the upper panel will engage the stop block 50, thus preventing further closing of the gap between the facing edges.

The coupling mechanism also provides for relative rotational movement between the panels 12*a,b*, which is required when the panels are in the being guided between vertical and horizontal orientations by the curved portion 24 of the track 20, as seen in FIG. 1. As shown in FIG. 6, the pliable hinge member body 36 bends while the expanded regions are retained by the shoulders of their respective recesses 40, thereby allowing the necessary rotational movement between the panels.

Figure 7:
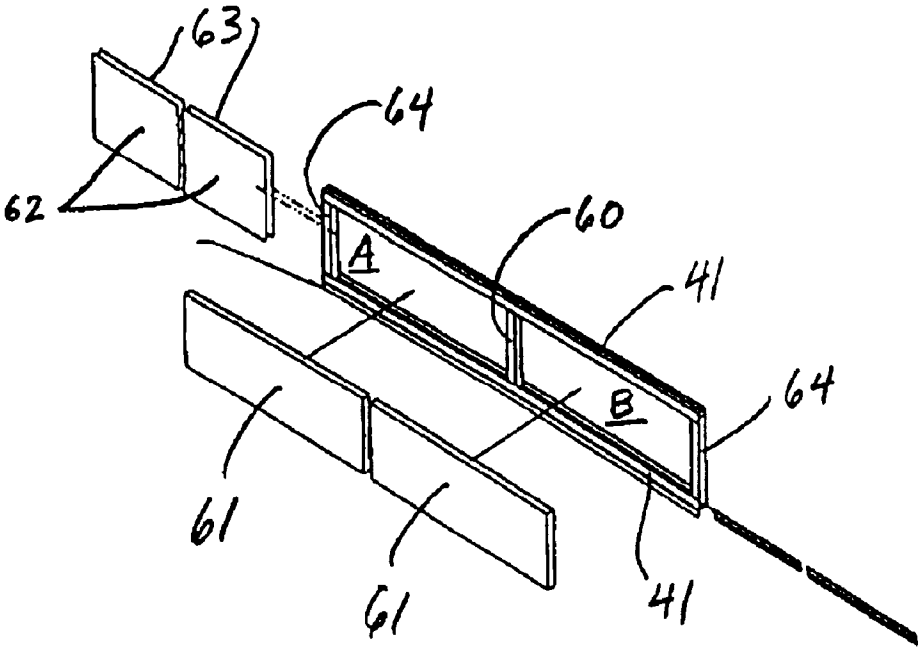
FIG. 7 is an exploded view of an exemplary panel according to an aspect of the present invention.

A detailed, exploded view of panel 12 is shown in FIG. 7, and illustrates advantageous features of the panel according to this embodiment of the invention. The panel 12 of the present embodiment is formed of a frame, comprising the extrusions 41, connected together by at least one weldment, such as 60, to form the frame (see FIG. 7). Blocks of material, illustratively having polystyrene cores 61 sandwiched between extruded polyethylene skin panels 62, 63, are then inserted into the central areas A and B formed by the frame. Side endcaps 64 may then be fitted over the resulting panel, and may include mountings for the rollers associated with the panel. A panel 12 formed in this manner has advantages over other composite sectional door panels. Such panels typically include core layers and skin layers (and sometimes other layers) which are glued, riveted, or bolted together to form the panel. In temperature-cycling situations, the various layers may thermally expand and contract at different rates. This causes relative movement between the layers, placing stress on the attachment mechanism (glue, bolts, rivets) between the layers, and unduly degrading performance and lifetime for the door. In the present panel, the layers are simply held in a frame, rather than being attached together (see FIG. 3). This allows for relative movement between the layers, greatly increasing the panel's performance in variable temperature conditions. Although the coupling mechanism has been described in reference to the embodiment of FIGS. 1–6, the invention is not so limited. For example, the coupling mechanism of the present invention could be used in combination with other types of panels. For example, a unitary panel, including suitable recesses 40 formed in its facing edges, could also be used. Alternatively, extrusions like those in the embodiment of FIGS. 1–6 could be bolted, screwed, or otherwise affixed to the facing edges of flat, unitary or composite panels to provide the recesses 40 according to the invention. So long as a coupling mechanism for a sectional door includes recesses disposed on facing edges of adjacent panels, a pliable hinge member having expanded end regions disposed within the recesses to provide for relative movement between the facing edges, and a stop member for maintaining a minimum spacing between the facing edges, such a coupling mechanism falls within the scope of the present invention.

Various other features may be advantageously included on a door including a coupling mechanism according to the invention. For example, given that the stop block 50 is intended to hold the respective panels 12 spaced, a gap is always present between the panels. Such a gap, while reducing the possibility for pinching, and having other advantages, may be undesirable from an aesthetic perspective, and may also allow for undue leakage of air or light through the door. The leakage issue would be a particularly sensitive one in an embodiment of the invention where the hinge member was in the form of a series of spaced, pliable hinges, since there would be open spaces between the hinges in a given gap. Accordingly, seals or covers for both the back and front of the gap may be desirable. By the "front" it is intended to mean that part of an overhead storing door that faces up when the door is stored. It is this section of the door that bows outward during travel from blocking to unblocking positions. The "back" of a given gap is thus that part of the gap on the "inside" of the door, which bows inward during travel through the curved portion of the track. Since the back of the gap gets compressed when the door is in this curved portion (see FIG. 6), the seal or cover for the back of the gap must be pliable. Such a seal is shown in FIGS. 4–6. The pliable seal 70 is an elongated blade of material disposed within a seal-receiving recess 72 formed on a panel 12 with which the seal is associated. As with the recess 40 of the coupling mechanism, the seal-receiving recess 72 may either be formed integrally in a panel 12, or may be part of an extrusion or endcap fixed to or forming a panel 12. Alternatively, the blade seal 70 could be affixed adjacent the facing edge of the panel. The pliable seal 70 is disposed such that it covers the gap for all orientations of the respective panels 12. In the vertical orientation, it extends over the gap. As the back of the gap compresses as the panels move along the curved portion of the track, the blade 70 maintains contact with both of the extrusions 41*a,b* and is bent and compressed thereby (FIG. 6). Thus, with the door in this orientation, the blade seal 70 also serves as a cover to the gap, minimizing the possibility that something will be pinched in the compressing gap.

The seal or cover for the front of the gap need not be pliable, like the blade seal 70. This is due to the fact that the front of the gap bows out during travel in the curved region, and thus the seal is not compressed. The front seal 80 may thus simply be either a pliable or a rigid or semi-rigid piece of material that is fixed adjacent the facing edge of a panel 12, and which extends over the gap that the panel makes with an adjacent panel with the door in a vertical or horizontal orientation.

Figure 8:
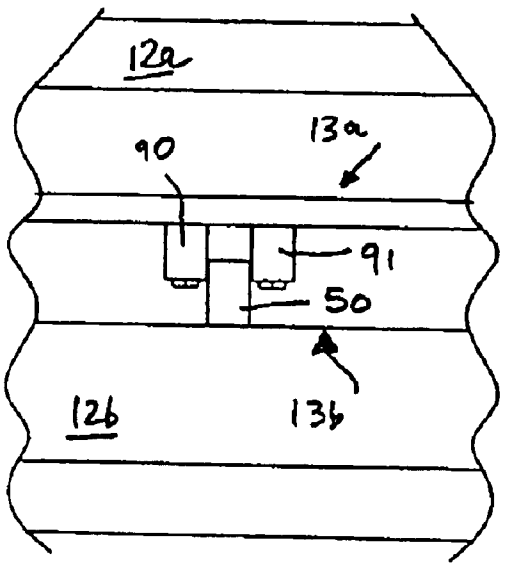
FIG. 8 is an elevation showing a lateral stop mechanism according to a further aspect of the invention.

Another feature of the invention would be advantageous in a sectional door that provides for breakaway. Such a sectional door would include a mechanism for allowing the lateral edges of the panels 12 to separate from the tracks for an undue impact. Such a feature is very advantageous for preventing damage to a sectional door. Once the panels are broken away, however, and with a coupling mechanism like that shown in the embodiment of FIGS. 1–7, nothing will prevent the panels from moving laterally with respect to each other. Such lateral movement may make it difficult to re-insert or re-feed the panel edges and/or the rollers back into the tracks, as the rollers and tracks would be misaligned. To avoid such a problem, the coupling mechanism according to the invention may also include a lateral stop mechanism. Such a lateral stop mechanism is illustrated in FIG. 8. In its simplest form, the lateral stop mechanism comprises a pair of lateral stops 90, 91 attached to the facing edge 13 a of the panel facing the panel edge 13*b* upon which the stop block 50 is mounted. The lateral stops 90, 91 are separated by a distance substantially equal to the width of the stop block 50. Engagement of the stop block 50 with the lateral stops 90, 91 thus prevents relative lateral movement of the panels 12*a,b*.

An improved coupling mechanism for sectional doors has thus been disclosed. It is simple to implement, as it includes only facing recesses, a pliable hinge member and a stop block, yet it is safe and reliable to operate. Various advantageous features may also be combined with this novel coupling mechanism.

What is claimed is:

1. A sectional door having a plurality of hingedly interconnected panels, at least one of the panels comprising, in combination:

a frame defining at least one central area, the frame including a horizontal member coupled to a hinge member hingedly connecting the panel to another sectional door panel; and a plurality of material layers received within the central area of the frame and held in place by the frame, the layers being movable relative to each other.

2. A panel according to claim 1, wherein the frame comprises first and second aluminum extrusions, joined together by at least one weldment.

3. A panel for a sectional door, comprising in combination:

a frame defining at least one central area, the frame including a horizontal member adapted to be coupled to a hinge member for hingedly connecting the panel to another sectional door panel, the frame comprising first and second aluminum extrusions joined by at least one weldment; and a plurality of material layers received within the central area of the frame and held in place by the frame, layers being moveable relative to each other, wherein the layers comprise a polystyrene core sandwiched between polyethylene skin layers.

4. A method for forming a sectional door having a plurality of hingedly interconnected panels, the method comprising:

providing a frame defining at least one central area;

inserting layers of material into the central area to be held in place by the frame, and to provide relative movement between the layers; and coupling a hinge member to the frame and another sectional door panel.

* * * * *